US005627415A

United States Patent [19]

Charpentier et al.

[11] Patent Number: 5,627,415

[45] Date of Patent: May 6, 1997

[54] SYSTEM AND METHOD FOR OPENING/ CLOSING CIRCUIT BREAKERS

[75] Inventors: Claude Charpentier, Verdun; Raymond Rajotte, St. Leonard, both of Canada

[73] Assignee: Hydro-Quebec, Montreal, Canada

[21] Appl. No.: 498,049

[22] Filed: Jul. 5, 1995

Related U.S. Application Data

[63] Continuation-in-part of PCT/CA94/00148, Mar. 15, 1994 which is a continuation-in-part Ser. No. 34,397, Mar. 18, 1993, Pat. No. 5,430,599.

[51] Int. Cl.[6] ..... H01H 9/00

[52] U.S. Cl. ..... 307/116; 307/117; 307/127; 307/131; 361/3; 361/5; 361/7; 361/139; 361/152; 361/187

[58] Field of Search ..... 307/116, 117, 307/127, 131; 361/152, 187, 3, 5, 7, 139

[56] References Cited

PUBLICATIONS

Article "Field Tests of a Circuit Breaker Synchronous Control" 95 WM 011-7 PWRD presented at IEEE/PES Winter Meeting, Feb. 2, 1995, in New York – Raymond J. Rajotte et al, pp. 1–9.

*Primary Examiner*—William M. Shoop, Jr.
*Assistant Examiner*—Albert W. Paladini
*Attorney, Agent, or Firm*—Oblon, Spivak, McClelland, Maier & Neustadt, P.C.

[57] ABSTRACT

The first zero crossing of the power signal, after the detection of an opening/closing signal, initiates a series of predetermined, timed, steps which reduces or eliminates the overvoltage after opening/closing a circuit breaker on a high power line.

12 Claims, 3 Drawing Sheets to
tco
tarc
tmo
ty
OPEN
BREAKER CLOSED tc
tcc
8.33 ms
tdel
tmc
tx
CLOSED
BREAKER OPEN

SYSTEM AND METHOD FOR OPENING/CLOSING CIRCUIT BREAKERS

This application is a continuation-in-part of U.S. patent applications Ser. number PCT/CA94/00148 filed Mar. 15, 1994 and serial number 08/034,397 filed Mar. 18, 1993, now U.S. Pat. No. 5,430,599.

TECHNICAL FIELD

The invention relates to a system and method for timing the opening and closing of switching arrangements used in high power electrical transmission systems. More specifically, the invention relates to such a system which takes into account conditions of temperature surrounding the switching arrangements as well as the mechanical displacement time of the electrical contacts of the switching arrangements.

BACKGROUND ART

Switching arrangements, for example, circuit breakers, are used in electrical transmission lines or distribution lines to redirect power, or are used to connect the lines to reactive elements to correct power factor. Such breakers, because of the large amounts of power they must handle, are very large (approximately the size of a small house on each phase) and are very costly.

Associated with such breakers are resistive elements, which are connected in parallel to the breakers just before the opening and closing of the breakers, to absorb the "overvoltages" which accompany the opening and closing of the breakers to thereby protect the switching elements of the breakers as well as the reactive elements. The resistive elements are also large and expensive.

Prior art controlled switching arrangements (breakers) are known from EP 0 338 374 (ABB) and JP03-241,625 (Toshiba).

It is a well known fact in the art that the temperature surrounding the breaker has an effect on the speed of operation of the breakers. Generally speaking, the lower the temperature, the greater amount of time needed to open or close the breakers and vice-versa.

SUMMARY OF THE INVENTION

It is an object of the invention to provide a system for timing the opening and closing of switching arrangements which obviates the needs for resistive elements.

It is a more specific object of the invention to provide such a timing system which will open and close the breakers at such a time in the cycle of the transmitted signal whereby to minimize the overvoltage due to the opening and closing of the breaker.

In accordance with a particular embodiment of the invention there is provided a system for timing the opening and closing of a switching arrangement (1) used in high power electrical transmission systems which transmit at least one phase of an AC power signal (A,B,C) comprising: phase angle detector means (9) for detecting a phase of the power signal and for providing a phase indication signal; sensing means (10) for sensing parameters useful for controlling operation of the switching arrangement and producing a temperature signal; and control means (7) connected to the phase detector means, and the sensing means for opening and closing the switching arrangement characterized in that: the system comprises switch means (11) for providing an OPEN/CLOSE initiating signal for initiating the opening/closing of the switch arrangement; the sensing means sense only ambient temperature; the control means are connected to the switch means and generate a switching arrangement opening and closing signal in response to the initiating signal timed as a function of the temperature signal and the phase indication signal; the control means include means for calculating $t_{mo2}$ for different temperatures according to the formula: $t_{mo2}=t_{mo1}-a_o\ (T_2-T_1)$ where $a_o$ is a value which is indicative of the sensitivity of the switching arrangement to temperature and is given by a manufacturer of the switching arrangement; $T_2$ is the ambient temperature; $T_1$ is a standard temperature; $t_{mo1}$ is a precalibrated switch opening time at the standard temperature; $t_{mo2}$ is a switch opening time at temperature $T_2$; and the control means include means for calculating $t_{mc}$ for different temperatures according to the formula: $t_{mc2}=t_{mc1}-a_c\ (T_2-T_1)$ where ac=a value which is indicative or sensitivity of the switching arrangement to temperature and is given by a manufacturer of the switching arrangement; $T_2$=temperature of interest; $T_1$=a standard temperature; $t_{mc1}$=a precalibrated switch closing time at the standard temperature; $t_{mc2}$=switch closing time at temperature $T_2$.

From a different aspect and in accordance with a particular embodiment of the invention there is provided a method for timing the opening and closing of a switching arrangement used in high power electrical transmission systems which transmit at least one phase of a power signal having a sinusoidal variation, comprising: detecting a phase angle of the power signal and generating a phase indication signal; sensing parameters useful for controlling operation of the switching arrangement and producing a temperature signal; and controlling opening and closing of the switching arrangement characterized in that: the method further comprising a step of providing an OPEN/CLOSE initiating signal to initiate the opening/closing of the switching arrangment; the step of sensing comprises sensing ambient temperature only; the step of controlling comprises generating a switching arrangement opening and closing signal in response to the initiating signal timed as a function of the temperature signal and the phase indication signal; the step of controlling further including a step of calculating $t_{mo2}$ for different temperatures according to the formula: $t_{mo2}=t_{mo1}-a_o\ (T_2-T_1)$ where $a_o$ is a value which is indicative of the sensitivity of the switching arrangement to temperature and is given by a manufacturer of the arrangement; $T_2$ is an ambient temperature; $T_1$ is a standard temperature; $t_{mo1}$ is a precalibrated switch opening time at the standard temperature; $t_{mo2}$ is a switch opening time at $T_2$, when controlling the opening of the switch arrangement; and $t_{mc}$ is for different temperatures according to the formula: $t_{mc2}=t_{mc1}-a_c\ (T_2-T_1)$ where $a_c$=a value which is indicative of the sensitivity of the switching arrangement to temperature and is given by a manufacturer of the switching arrangement; $T_2$=ambient temperature; $T_1$=a standard temperature; $t_{mc1}$=a precalibrated switch closing time at the standard temperature; $t_{mc2}$=a switch closing time at temperature $T_2$.

BRIEF DESCRIPTION OF DRAWINGS

The invention will be better understood by an examination of the following description, together with the accompanying drawings, in which.

DETAILED DESCRIPTION OF PREFERRED EMBODIMENTS

Figure 1:
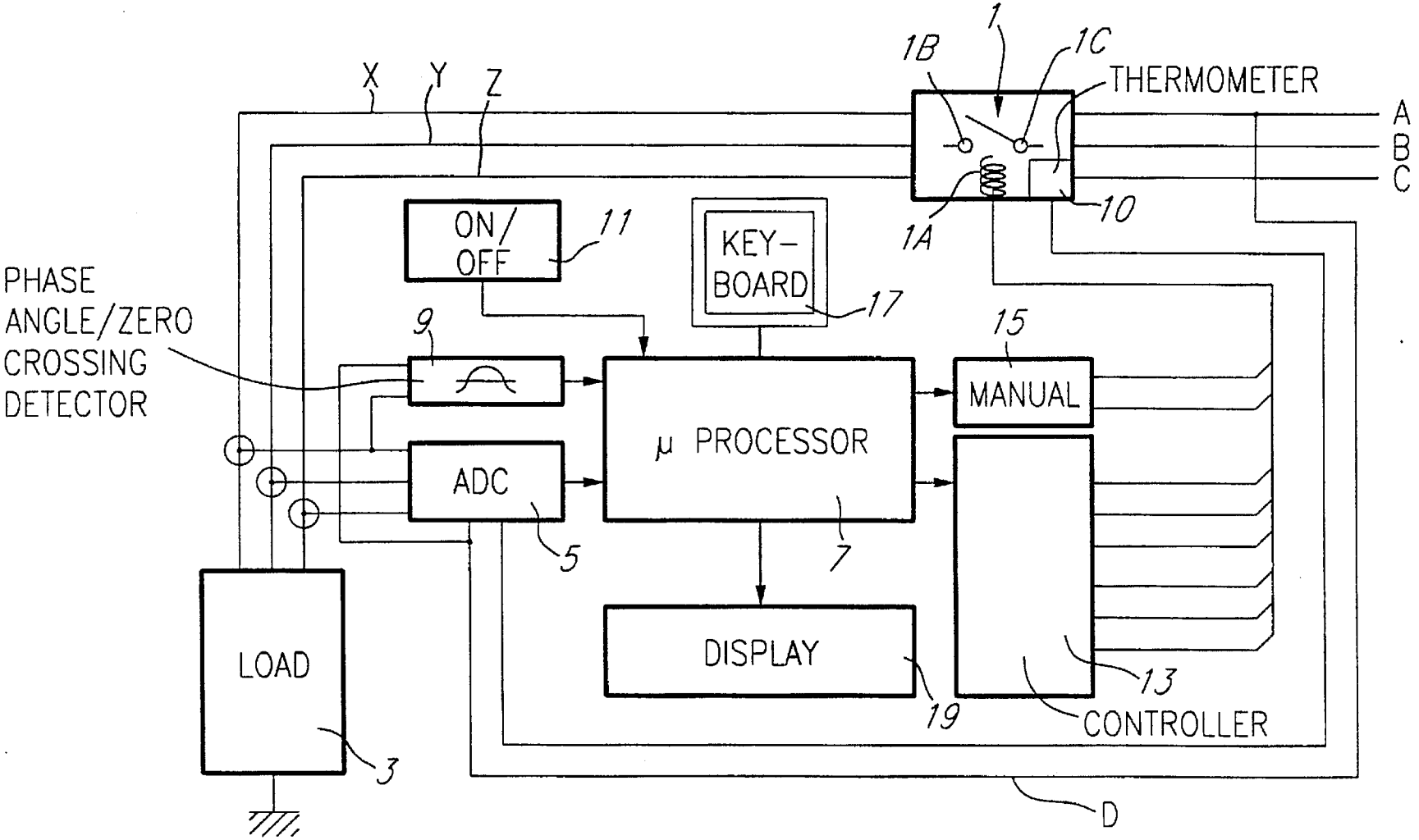
FIG. 1 is a block diagram of the system.

Referring to FIG. 1, a circuit breaker, illustrated schematically at 1, and having coil means represented schematically at 1A and electrode means represented schematically at 1B and 1C, is connected between the three phases, A, B and C, of transmitted power, and a reactive element illustrated schematically at 3. When the breaker is opened, the measured tension of one of the phases, in the illustrated embodiment phase A, is connected to an analog-to-digital (A/D) converter 5 by conductor D. The magnitude, frequency and other characteristics of the phase A signal are translated from an analog value to a digital value in A/D converter 5, and the digital signal is then fed to a microprocessor 7. In addition, the phase A signal is fed to a phase angle/zero crossing detector 9 ("zero detector 9"), which is a phase angle detector that preferably includes a zero crossing detector, wherein the zero crossings of the phase A signal are detected. When a phase A zero crossing is detected, a pulse or other indication is fed to the microprocessor 7. As will be apparent, the zero crossings of phase A are used for synchronization purposes.

A thermometer, illustrated schematically at 10, measures the temperature surrounding the circuit breaker. An electrical analog of the temperature is then fed to the A/D (analog to digital) converter 5, and the digital conversion of the temperature is also fed to the microprocessor 7.

When the breaker is closed, phase A, B and C signals are fed along conductors X, Y and Z, and the phases A, B and C measured currents are fed to the A/D converter 5 as shown in FIG. 1. Once again, the analog signals are convened to digital signals and the digital signals are fed to the microprocessor 7. The signal of the phase A is also fed to the zero detector 9, and, once again, a pulse or other indication is fed to the processor 7 when a zero crossing is detected.

The currents on phases A, B and C are monitored in order to detect any restrike that might occur when the circuit breaker opens or high inrush current when the circuit breaker closes.

Alarm signals are generated when a restrike or a high inrush current occurs on any of the three phases.

The currents on each phase are measured with current transformers installed on reactor 3 in FIG. 1. The phase A, B and C measured currents are fed to the A/D converter 5. The analog signals are converted to digital signals and the digital signals are fed to the microprocessor 7. The numerical values of the currents on each phase, during a period of 100 ms after the calculated closing time $t_c$ (FIG. 2) or opening time $t_o$ (FIG. 3) of the breaker, are stored in the memory of the microprocessor. If the numerical value of the current on any of the three phases exceeds a preset value entered in the microprocessor, a high-inrush-current alarm or a re-ignition alarm is triggered. The state of the alarm is memorized by the microprocessor as well as the identity of the phase that triggered the alarm. At the same time, a light on the front panel of the system is turned on and a pulsed alarm signal of 500 ms is sent to the substation operator by means of a closing contact.

The opening or closing of the breaker is initiated by ON/OFF switch 11. The signal from the ON/OFF switch is, once again, fed to the microprocessor 7.

The output of the microprocessor 7 is fed to a controller 13 which will either open or close the breakers, associated with the A, B or C phases under the control of the microprocessor 7, by carrying out a series of predetermined, timed, steps as described below. If the system cannot operate to open or close the breaker under the control of the controller 13, an emergency override 15 is provided to open or close the breakers, once again, under control of the microprocessor 7.

A keyboard 17 is provided for the purpose of programming the microprocessor 7, as is well known in the art, and a display unit 19 is provided for examining various parameters and alarm signals, once again, as is well known in the art.

To understand the operation of the system, reference is had to FIG. 2, for an understanding of the opening operation, and to FIG. 3 for an understanding of the closing operation. Generally, the system is either in a waiting mode, that is, when an opening or closing has not been commanded, or an active mode in which the breaker is either being opened or closed. In the waiting mode, temperature readings are taken at predetermined intervals by the thermometer 10, and an electrical analog of the temperature is provided to the A/D converter 5. The digital representation of the temperature is then provided to the processor 7.

At the same time, during the waiting mode, the functionality of the system is verified by means well known in the art. Parameters are also calculated taking into account the changing temperature.

Figures 2A, 2B, 2C, 2D, 2E, 2F:
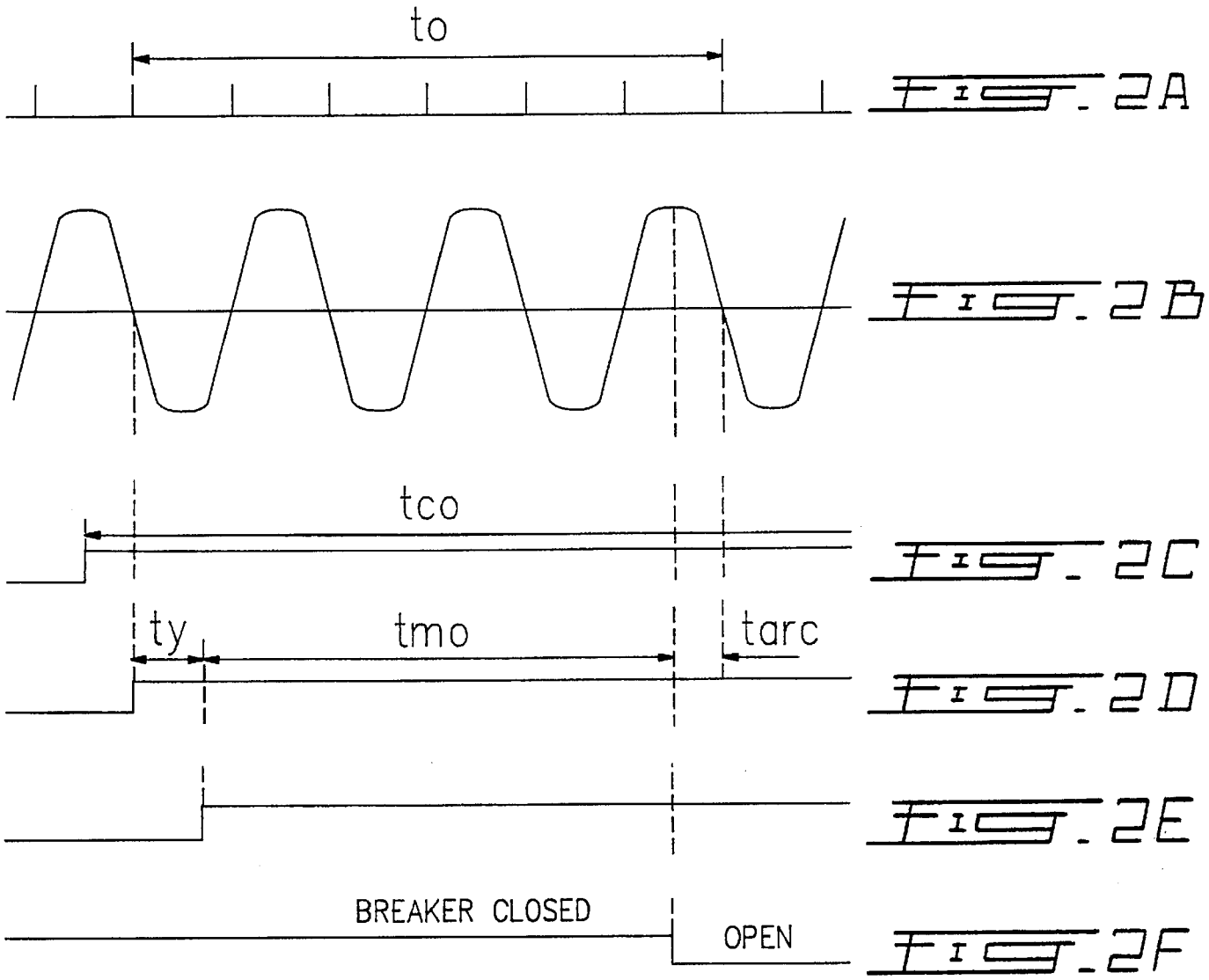
FIGS. 2A to 2F are graphs useful in under-standing the steps which take place upon issuance of an opening command.

Turning now to FIG. 2, in accordance with the invention, the complete opening procedure, $t_o$, is performed during an integral number of cycles, i.e. in a time n ($t_{cycle}$), where $t_{cycle}$=period of a cycle and n=a predetermined integer. As illustrated in FIG. 2A, the number of integral cycles in which the complete opening procedure is performed in one particular embodiment is 3. As illustrated in FIG. 2B, the transmitted signal is a sinusoid. In North America, the frequency of the transmitted signal is, of course, 60 Hz so that $t_{cycle}$=16.67 msec.

The signal for opening the breaker (separating the electrodes of the breakers from each other: the signal is initiated by pressing the ON button in the switch 11 in FIG. 1) is given at the beginning of a period $t_{co}$. The signal $t_{CO}$ is illustrated in FIG. 2C and is the time duration during which the opening signal remains high. As can be seen in FIG. 2C, $t_{CO}$ remains high during the entire opening procedure and stays open until a closing signal is initiated.

The high level at the onset of $t_{CO}$ is fed to the microprocessor 7 and the microprocessor 7 then seeks a zero of the sinusold at the first zero crossing after the initiation of $t_{CO}$. As seen in FIGS. 2B and 2D, this occurs at the beginning of the period $t_y$ in FIG. 2D).

It is only after the waiting period $t_y$, that is, at the beginning of the period $t_{mo}$, (see FIG. 2D) that power is applied to the coil of the circuit breaker to initiate the movement for the physical separation of the electrodes of the breaker as shown in FIG. 2E.

As seen in FIG. 2F and 2D, the contacts separate at the conclusion of the period $t_{mo}$, that is, at a period $t_{arc}$ before the next zero crossing.

When the electrodes of the breakers are physically separated, an arc is formed between the electrodes. The arc is extinguished when the current reaches the zero level, that is, at the conclusion of the period $t_{arc}$.

To prevent restrikes inside the breaker after the current goes to zero, the duration of the arc, identified as $t_{arc}$ in FIG. 2D, should be greater than 3 milliseconds. If it is less than this, then the current will pass through zero and increase (in either a positive or negative direction) while the arc is still strong enough to restrike. Accordingly, $t_{arc}$ should be a minimum of 3 milliseconds.

In addition, to guard against the uncontrollable variation in the amount of time that it takes for the physical separation of the electrodes to occur ($t_{mo}$), which variation could be of the order of 2 milliseconds, it is preferable that the period $t_{arc}$ should be of the order of 5 milliseconds.

The actual magnitude $t_{arc}$ is entered into microprocessor 7 by keyboard 17. The period $t_{mo}$ is determined by a calibration procedure at a standard temperature, for example, 20° C.

It will then be observed that $$t_o t_y + t_{mo} t_{arc} \quad (1)$$

As $t_o$ is known (in the present example, $t_o$=3 cycles. In the North American case, each cycle is equal to 16.6 msec so that $t_o$=50 msec) and $t_{arc}$ is selected to be of the order of 5 milliseconds. The value of $t_{mo}$ is determined, at the standard temperature, by calibration, and the value of $t_y$ is calculated by the microprocessor 7.

In order to determine the values of the above periods at temperatures other than 20° C., the opening time $t_{mo2}$ at temperature $T_2$ is calculated using the relationship $$t_{mo2} = t_{mo1} - a_o(T_2 - T_1) \quad (2)$$

where

A. is a value which indicative of the sensitivity of the breaker to temperature and is given by the breaker manufacturer $T_2$ is equal to the temperature of interest $T_1$ is equal to the standard temperature equal to, in a particular embodiment,

20° C.

$t_{mo1}$ is equal to the switch opening time 20° C.

$t_{mo2}$ is equal to the switch opening time $T_2$.

The value of $t_{mo2}$ is calculated with equation (2), and the value of $t_y$ is calculated using the programmed value of $t_{arc}$ and the calculated value of $t_{mo2}$ applied in equation (1) above.

With the above calculation, the parameters for opening ti:e breaker are determined. The processor 7 sends out signals to the controller 13 which initiates appropriate action (e.g. applying an opening signal to the coil of the breaker) to affect the opening in accordance with the calculated timing.

As seen from FIG. 1, the zero crossing is determined only for phase A. However, as phases B and C have a known phase relationship to phase A (e.g. phase B is separated from phase A by angle $P_a$ and phase C is separated from phase B by angle $P_b$), timing for these phases is determined in a straightforward manner. Specifically, the zero crossing occurs at $P_a/360(t_{cycle})$ msec after the zero crossing for phase A. In a like manner, the zero crossing for phase C occurs at $P_b/360$ ($t_{cycle}$) after the zero crossing for phase A.

In practice, temperature readings are taken at predetermined intervals and the value for $t_{mo}$ is calculated whenever a temperature reading is taken. When an actuating signal is received, the value of the last calculated $t_{mo}$, is used.

In addition, the $t_{mo}$ of phase A may not be identical with the $t_{mo}$ of phase B or of phase C. Accordingly, separate calculations have to be made at each temperature for the value $t_{mo}$ of each phase. Further, the value $a_o$ may also be different from each phase. The values for $a_o$ for each phase are stored in the processor 7 and are identified as such to perform appropriate calculations.

As is also well known, it is not possible to continuously convert the analog signal to a digital value. Instead, samples have to be taken. In accordance with a particular embodiment of the invention, 32 samples are taken during each cycle of the voltage/current.

Figures 3A, 3B, 3C, 3D, 3E, 3F:
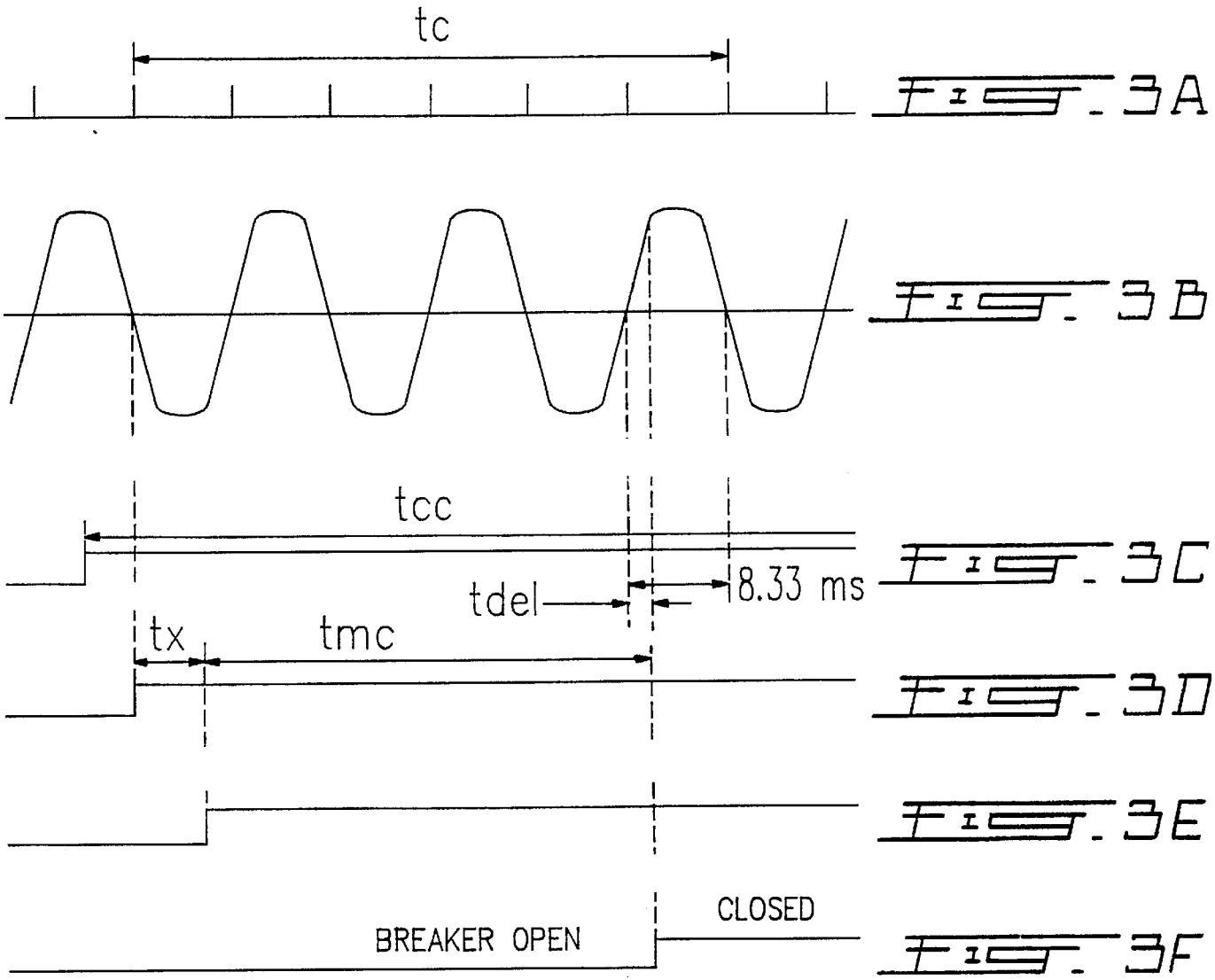
FIGS. 3A to 3F are graphs useful in under-standing the steps which take place upon issuance of a closing command.

The parameters for determining the closing times for the breakers are illustrated in FIG. 3. As seen in FIG. 3A, the total closing time $t_c$ is once again equal to an integral number of cycles. Once again, the number of cycles illustrated in FIG. 3 is 3.

The closing signal is, as seen in FIG. 3C, initiated at the beginning of the time period $t_{cc}$. Once again, the computer monitors for the first zero crossing, illustrated in FIGS. 3B and 3D as appearing at the beginning of the time period $t_x$. $t_x$ is a waiting period and a closing signal is applied to the coil of the breaker at the expiration of the period $t_x$. As seen in FIGS. 3D and 3E, this occurs at the beginning of the period $t_{mc}$. The period $t_{mc}$, that is, the time that it takes the contacts to move from an open to a closed position, is once again a function of the particular breaker and is once again calibrated at a standard temperature, for example, 20° C. In order to determine the period $t_{mc2}$ for a temperature $T_2$, different from 20° C., use is made of the relationship $$t_{mc2} = t_{mc1} - a_c(T_2 - T_1) \quad (3)$$

where $A_c$ is one again given by the manufacturer of the breakers. It can also be seen from FIG. 3 that $$t_c = t_x + t_{mc} + \tfrac{1}{2}T - t_{del} \quad (4)$$

where T is the signal period (½ T=8.33 msec for a 60 Hz signal).

As $t_c$ and $t_{mc}$ are already known, and as $t_{del}$ is selected to enable the exact point of initiation (the onset of the period $t_{mc}$) to be fixed with exactness, the period $t_{del}$ is also known, and the period $t_x$ can be determined from equation (4).

By definition, $t_{del}$ is the time delay between the last zero crossing of the phase voltage before the mechanical closure of the circuit breaker contacts and the actual contact closure. When the circuit breaker is used with an inductance or with a transformer, $t_{del}$ should be set around 2 ms in order to avoid the high inrush currents which can cause high electrodynamic stresses on the windings. High inrush currents occur when the breaker contacts close near zero phase voltage i.e. when $t_{del}$ is close to zero. Conversely, when the circuit breaker is used with a capacitor bank, $t_{del}$ should be close to zero in order to prevent high inrush currents which would stress the capacitors and damage the contacts of the circuit breaker.

As seen in FIG. 3F, the contacts move from an open to a closed position upon termination of the period $t_{mc}$. Once again, the timing of phases B and C are determined knowing the relationship between the signals on phases A, B and C. In addition, the value $t_{mc2}$ must be separately calculated for each phase A, B or C taking into account the value of $a_c$ and of $T_2$.

Although a particular embodiment has been described, this was for the purpose of illustrating, but not limiting, the invention. Various modifications, which will come readily to the mind of one skilled in the art, are within the scope of the invention as defined in the appended claims.

We claim:

1. A system for timing the opening and closing of a switching arrangement used in high power electrical transmission systems which transmit at least one phase of an AC power signal (A,B,C) comprising:

phase angle detector means for detecting a phase of said power signal and for providing a phase indication signal;

sensing means for sensing a temperature and controlling operation of said switching arrangement and producing a temperature signal; and control means connected to said phase detector means, and said sensing means for opening and closing said switching arrangement;

switch means for providing an OPEN/CLOSE initiating signal for initiating the opening/closing of said switch arrangement; wherein said sensing means sense only ambient temperature;

said control means are connected to said switch means and generate a switching arrangement opening and closing signal in response to said initiating signal timed as a function of said temperature signal and said phase indication signal;

said control means include means for calculating $t_{mo2}$ for different temperatures according to the formula:

$$t_{mo2}=t_{mo1}-a_o(T_2-T_1)$$

where $a_o$ is a value which is indicative of the sensitivity of the switching arrangement to temperature and is given by a manufacturer of the switching arrangement $T_2$ is the ambient temperature $T_1$ is a standard temperature $t_{mo1}$ is a precalibrated switch opening time at said standard temperature $t_{mo2}$ is a switch opening time at temperature $T_{mo2}$; and said control means include means for calculating $t_{mc}$ for different temperatures according to the formula:

$$t_{mc2}=t_{mc1}a_c(T_2-T_1)$$

where $a_c$=a value which is indicative of the sensitivity of the switching arrangement to temperature and is given by a manufacturer of the switching arrangement $T_2$=ambient temperature $T_1$=a standard temperature $t_{mc1}$=a precalibrated switch closing time at said standard temperature $t_{mc2}$=switch closing time at temperature $T_2$.

2. The system as defined in claim 1, wherein said power signal is a three phase power signal and $a_o$, $a_c$, $t_{mo1}$ and $t_{mc1}$ are predetermined for each said phase, said control means generating separate opening and closing signals for each of said phases.

3. The system as defined in claim 1, further comprising a current detector, an open and close current threshold, detector means for determining whether current is above a predetermined restrike or inrush level after opening or closing said arrangement, said current threshold means having an alarm output.

4. A system as defined in claim 1, wherein said control means includes means for calculating a waiting time $t_y$ from the formula:

$$t_o=t_y+t_{mo2}+t_{arc}$$

where $t_o$=an opening time corresponding to a predetermined integral number of periods of said power signal $t_y$=waiting time $t_{arc}$=arcing time.

5. A system as defined in claim 1, wherein said control means includes means for calculating $t_x$ from the formula:

$$t_c=t_x+t_{mc2}+\tfrac{1}{2}T-t_{del}$$

where $t_c$=a closing time corresponding to a pre-determined integral number of periods of said power signal $t_x$=waiting time T=a time period of said power signal $t_{del}$=a time delay period.

6. The system as defined in claim 2, wherein said power signal comprises a first phase, a second phase and a third phase;

said first phase being separated from said second phase by a phase angle $P_a$;

said second phase being separated from said third phase by a phase angle $P_b$;

said control means includes means for initiating opening and closing a second phase portion of said switching arrangement at a time $P_a/360$ ($t_{cycle}$) after said control means has initiated opening and closing for said first phase; and said control means includes means for initiating opening and closing a third phase portion of said switching arrangement at a time $P_b/720$ ($t_{cycle}$) after said control means has initiated opening and closing for said first phase.

7. A method for tinting the opening and closing of a switching arrangement used in high power electrical transmission systems which transmit at least one phase of a power signal having a sinusoidal variation, comprising:

detecting a phase angle of said power signal and generating a phase indication signal;

sensing ambient temperature only for controlling operation of said switching arrangement and producing a temperature signal;

providing an OPEN/CLOSE initiating signal to initiate the opening/closing of said switching arrangment;

generating a switching arrangement opening and closing signal in response to said initiating signal timed as a function of said temperature signal and said phase indication signal; and controlling opening and closing of said switching arrangement; wherein:

said step of controlling further includes a step of calculating $t_{mo2}$ for different temperatures according to the formula:

$$t_{mo2}=t_{mo1}-a_o(T_2-T_1)$$

where $a_o$ is a value which is indicative of the sensitivity of the switching arrangement to temperature and is given by a manufacturer of the switching arrangement $T_2$ is an ambient temperature $T_1$ is a standard temperature $t_{mo1}$ is a precalibrated switch opening time at said standard temperature $t_{mo2}$ is a switch opening time at $T_2$, when controlling the opening of said switch arrangement; and said step of controlling further includes a step of calculating $t_{mc2}$ for different temperatures according to the formula:

$$t_{mc2}=t_{mc1}-a_c(T_2-T_1)$$

where $a_c$=a value which is indicative of the sensitivity of the switching arrangement to temperature and is given by a manufacturer of the switching arrangement $T_2$=ambient temperature $T_1$=a standard temperature $t_{mc1}$=a precalibrated switch closing time at said standard temperature $t_{mc2}$=a switch closing time at temperature $T_2$.

8. The method defined in claim 7, wherein said power signal is a three phase signal, and $a_o$, $a_c$, $t_{mc1}$ and $t_{mc1}$ are predetermined for each said phase, said step of generating said opening and closing signals being carried out for each one of said phases separately.

9. The method defined in claim 7 or 8, further comprising a step of detecting a current level in said power signal after opening or closing said switching arrangement, and generating an alarm output signal if said current level is above a predetermined restrike or inrush level respectively.

10. The method as defined in claim 7 or 8, further comprising a step of calculating $t_y$ from the formula:

$$t_o=t_y+t_{mo2}+t_{arc}$$

where $t_o$=an opening time corresponding to a pre-determined integral number of periods of said power signal $t_y$=waiting time $t_{arc}$=arcing time.

11. The method as defined in claim 7 or 8, further comprising a step of calculating $t_x$ from the formula:

$$t_c=t_x+t_{mc2}+\tfrac{1}{2}T-t_{del}$$

where $t_c$=a closing time corresponding to a pre-determined integral number of periods of said power signal $t_x$=waiting time at temperature $T_2$ T=a period of said power signal $t_{del}$=a time delay.

12. A method as defined in claim 8, wherein said power signal comprises a first phase, a second phase and a third phase;

said first phase being separated from said second phase by a phase angle $P_a$;

said second phase being separated from said third phase by a phase angle $P_b$;

said step of controlling further comprising steps of controlling a portion of said switching arrangement for said second phase and for said third phases, wherein opening and closing of said portions for said second phase is initiated at a time $P_d/360$ ($t_{cycle}$) after initiation for said first phase;

opening and closing of said portions for said third phase is initiated at a time $P_b/720$ ($t_{cycle}$) after initiation for said first phase.

* * * * *